US006058986A

United States Patent [19]

Bethuy et al.

[11] Patent Number: 6,058,986

[45] **Date of Patent: *May 9, 2000**

[54] BEVERAGE DISPENSING CONTROL

[75] Inventors: Timothy W. Bethuy, Cedar, Minn.; Errol Jeffrey Naimon, Appleton; Robert Charles Hall, Jr., Brown Deer, both of Wis.

[73] Assignee: IMI Cornelius Inc., Anoka, Minn.

[ * ] Notice: This patent issued on a continued prosecution application filed under 37 CFR 1.53(d), and is subject to the twenty year patent term provisions of 35 U.S.C. 154(a)(2).

[21] Appl. No.: 08/340,990

[22] Filed: Nov. 17, 1994

[51] Int. Cl.[7] ..... B65B 1/30

[52] U.S. Cl. ..... 141/198; 141/83; 141/95; 141/206; 141/360; 137/392; 222/640

[58] Field of Search ..... 141/95, 198, 83, 141/359, 360, 206, 351; 222/640, 641; 137/12.5, 807, 87.02, 392; 73/290, 290 R; 340/616, 618, 620, 621

[56] References Cited

U.S. PATENT DOCUMENTS

| | | | |
|---|---|---|---|
| 4,712,591 | 12/1987 | McCann et al. | 141/198 |
| 4,972,883 | 11/1990 | Hassell et al. | 141/1 |
| 4,974,643 | 12/1990 | Bennett et al. | 141/1 |
| 5,129,548 | 7/1992 | Wisniewski | 222/641 |
| 5,228,486 | 7/1993 | Henninger | 141/198 |

*Primary Examiner*—David J. Walczak
*Assistant Examiner*—Timothy L. Maust
*Attorney, Agent, or Firm*—Sten Erik Hakanson

[57] ABSTRACT

An electronic control for an automatic filling beverage dispensing valve is shown. The dispensing valve includes a valve body, a flow control mechanism and a solenoid. The valve further includes an electrically conductive cup actuated lever for operating a micro-switch that is operatively connected to the electronic control of the present invention. The valve body includes a nozzle and a stainless steel electrical contact for providing electrical connection between the electronic control and the beverage as it flows through the nozzle into a cup. The electronic control of the present invention is microprocessor controlled and includes an internal signal generator which generates a signal independent of the input line frequency supplying the power to the control. This generated signal is buffered and applied to the dispensing cup lever while simultaneously being applied to a reference input of a phase-locked loop detector circuit. When beverage fills a cup to the rim thereof the beverage can flow over the rim and thereby provide an electrical continuity between the electrically conductive lever and the stainless steel contact within the nozzle. Thus, a signal is conducted to an input of the phase locked-loop detector circuit where that electrical signal is compared to the generated reference signal. If the two signals are matched in both frequency and phase, the detector circuit generates a continuity detected signal to the micro-processor. The microprocessor thereby ends dispensing by de-energizing the solenoid.

18 Claims, 6 Drawing Sheets

100
START
102
SWITCH ON ?
NO
YES
104
C/P SWITCH ON ?
NO
YES
108
TURN OFF CUP LED
106
TURN ON CUP LED
110
ENERGIZE SOLENOID
112
SIGNAL DETECT ?
NO
YES
124
C/P SWITCH ON ?
NO
YES
114
TURN OFF SOLENOID
116
WAIT FOR DELAY
118
ENERGIZE SOLENOID
120
SIGNAL DETECT ?
NO
YES
126
C/P SWITCH ON ?
NO
YES
122
TURN OFF SOLENOID
128
SWITCH OFF ?
YES
NO
130
C/P SWITCH ON ?
NO
YES
132
ENERGIZE SOLENOID
134
SIGNAL DETECT ?
NO
YES
136
C/P SWITCH ON ?
NO
YES

BEVERAGE DISPENSING CONTROL

FIELD OF THE INVENTION

The present invention relates generally to beverage dispensing valves, and in particular to beverage dispensing valves that operate to automatically shut-off in response to the sensing of a full cup.

BACKGROUND OF THE INVENTION

Beverage dispensing valves having electronic control means for determining the fill level of a cup are well know in the art. Various examples are seen in U.S. Pat. No. 3,916,963 to McIntosh; U.S. Pat. No. 4,236,553 to Reichenberger; U.S. Pat. No. 4,738,285 to Belland; U.S. Pat. No. 4,753,277 to Holcomb et al.; and Re. U.S. Pat. No. 34,337 to Bennett. In general, these valves utilize the strategy of providing for an electric current to flow through the stream of beverage to an actuating arm operated by the cup, whereby continuity is established when beverage overflows the cup rim establishing electrical conductivity with the actuator arm. These valves have the advantage of permitting the operator to attend to a different activity rather than being required to wait while the beverage cup is being filled. Generally speaking, valves of this type work quite well. However, changes in line voltages or frequencies and transient voltage spikes have been found to result in false triggering, hence premature shut-off. In addition, threshold sensitivities can be affected in high humidity situations where if the sensitivity is set too low conduction of current as a result of the high humidity can also result in such faulty operation. Naturally, early closing of the valve is wasteful of time and requires the operator to either restart the filling procedure or override the automatic filling feature and fill the cup manually.

Accordingly, it would be highly desirable to have an automatic filling beverage dispensing valve that is resistant to premature shut-downs resulting from false triggering conditions.

SUMMARY OF THE INVENTION

The present invention concerns an electronic control for a beverage dispensing valve. The dispensing valve includes a valve body, a flow control mechanism and a solenoid. The valve further includes an electrically conductive cup actuated lever for operating a micro-switch that is operatively connected to the electronic control of the present invention. The valve body includes a nozzle and a stainless steel electrical contact for providing electrical connection between the electronic control and the beverage as it flows through the nozzle into a cup.

The electronic control of the present invention is microprocessor based and includes an internal signal generator which generates a signal independent of the input line frequency supplying the power to the control. This generated signal is buffered and applied to the dispensing cup lever while simultaneously being applied to a reference input of a phase-locked loop detector circuit.

In operation an empty cup is first placed against the cup lever thereby closing the micro switch and signaling the beginning of a dispense cycle to the microprocessor. The microprocessor energizes the solenoid allowing beverage to flow out of the nozzle into the cup, and in so doing, the beverage is in electrical continuity with the electrical contact located within the dispensing nozzle. When the beverage fills the cup to the rim thereof the beverage can flow over the rim and thereby provide an electrical continuity between the electrically conductive lever and the stainless steel contact within the nozzle. Thus, a signal is conducted to an input of the phase locked-loop detector circuit where that electrical signal is compared to the generated reference signal. If the two signals are matched in both frequency and phase, the detector circuit generates a continuity detected signal to the micro-processor. The micro-processor thereby ends dispensing by de-energizing the solenoid. Thus, it can be appreciated by those of skill in the art that spurious electrical signals will not deactivate dispensing as such deactivation can only occur if the generated signal is detected.

DESCRIPTION OF THE DRAWINGS

A better understanding of the structure, function, operation and advantages of the present invention can be had by referring to the following detailed description which refers to the following figures, wherein.

DETAILED DESCRIPTION

Figure 1:
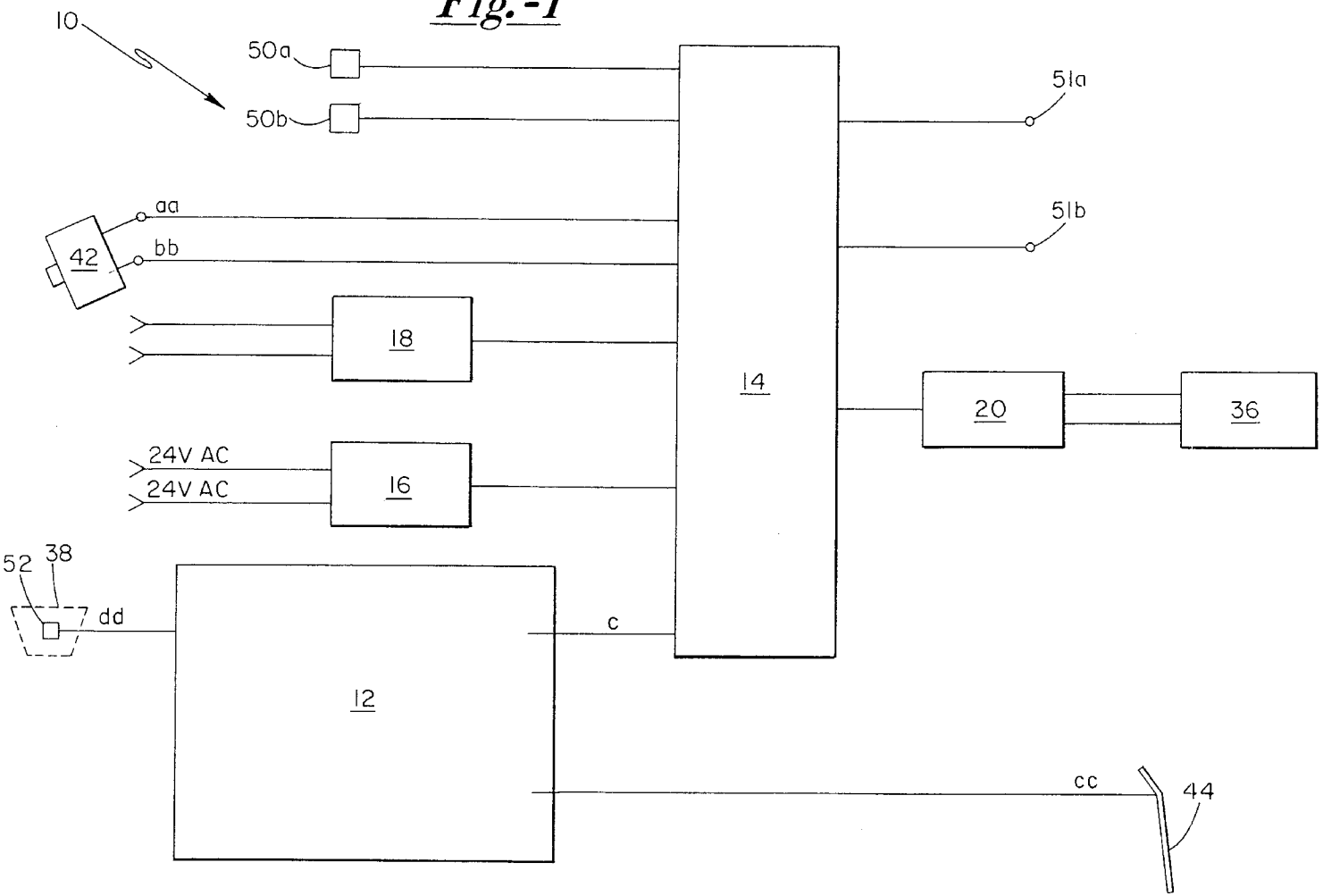
FIG. 1 shows block diagram of the electronic control of the present invention.

A schematic diagram of a preferred embodiment of the control of the present invention is seen in FIG. 1, and generally referred to by the numeral 10. Control 10 includes a signal generating and detecting circuit 12, a microprocessor 14, a power supply circuit 16, an input buffered circuit 18, and a solenoid driver circuit 20.

Figure 2:
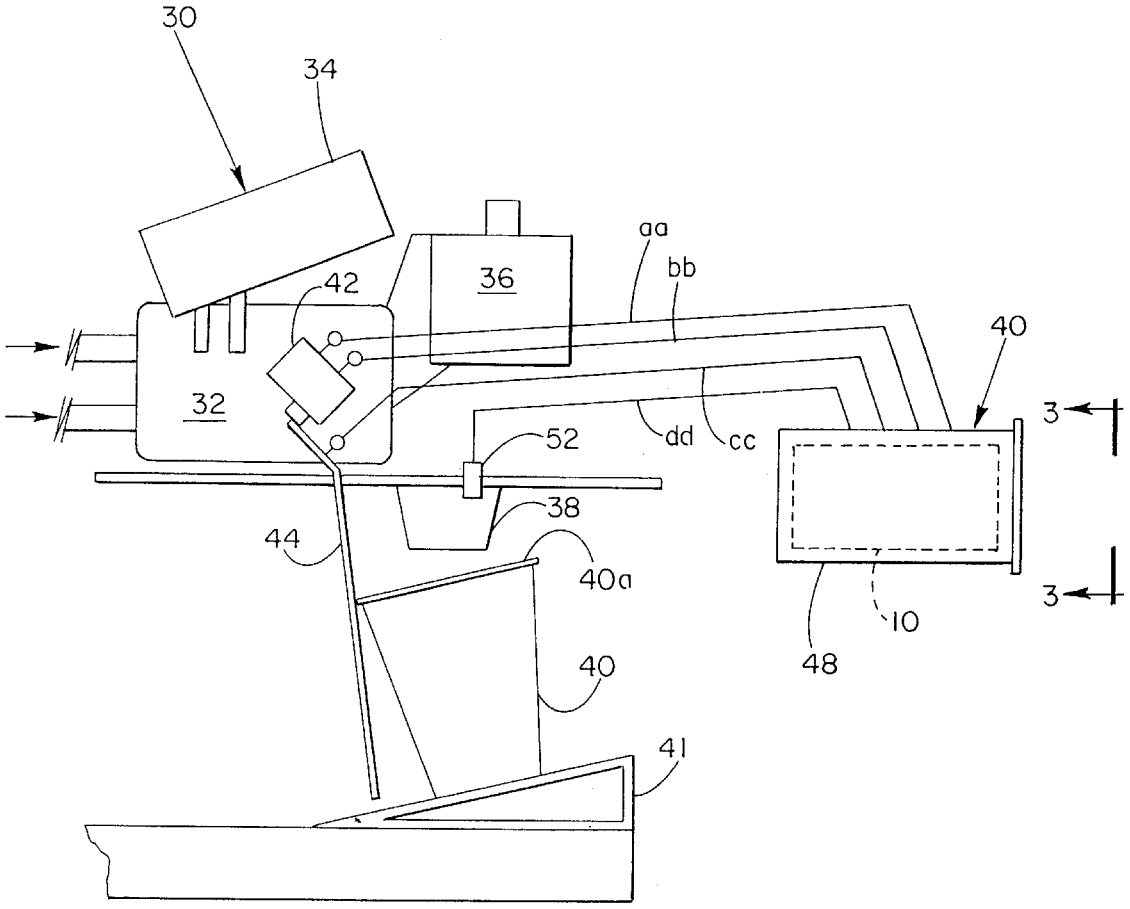
FIG. 2 show a schematic representation of a beverage dispensing valve.
Figure 3:
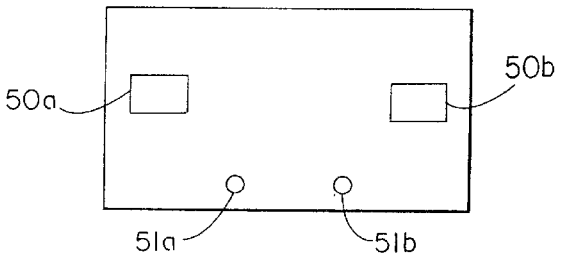
FIG. 3 shows a front plan view along lines 3—3 of FIG. 2.

As seen by referring to FIG. 2, a schematic diagram of a beverage dispensing valve 30 is shown. Such valves are well known in the art, as seen for example, in U.S. Pat. Nos. 4,549,675 and 5,285,815, which patents are incorporated herein by reference thereto. Valve 30 includes a valve body 32 for connecting to a source or sources of beverage, not shown, a flow control mechanism 34, and a solenoid 36. As is understood in the art, solenoid 36 operates to actuate valves, not shown, located within valve body 32, for directing a flow of beverage through a nozzle 38 into a cup 40 situated there below. Cup 40, having a rim 40*a,* is preferably supported on an inclined cup rack 41 wherein cup 40 is held in a non-level orientation. Valve 30 also includes a microswitch 42 actuated by a lever arm 44 pivotally suspended to and below valve 30. Control 10 is located substantially within a control housing 48. Housing 48, as also seen by referring to FIG. 3, includes a front face having two switches 50*a,* and 50*b,* and two LED's 51*a* and 51*b*. Housing 48 also includes wires aa and bb for providing electrical continuity from control 10 to micro switch 42, and line cc for providing electrical continuity from control 10 to lever arm 44. In addition, a stainless steel rivet 52 is mounted interior of nozzle 38 in the flow path of the beverage there through, and includes electrical line dd for providing electrical connection thereof to control 10.

Figure 4:
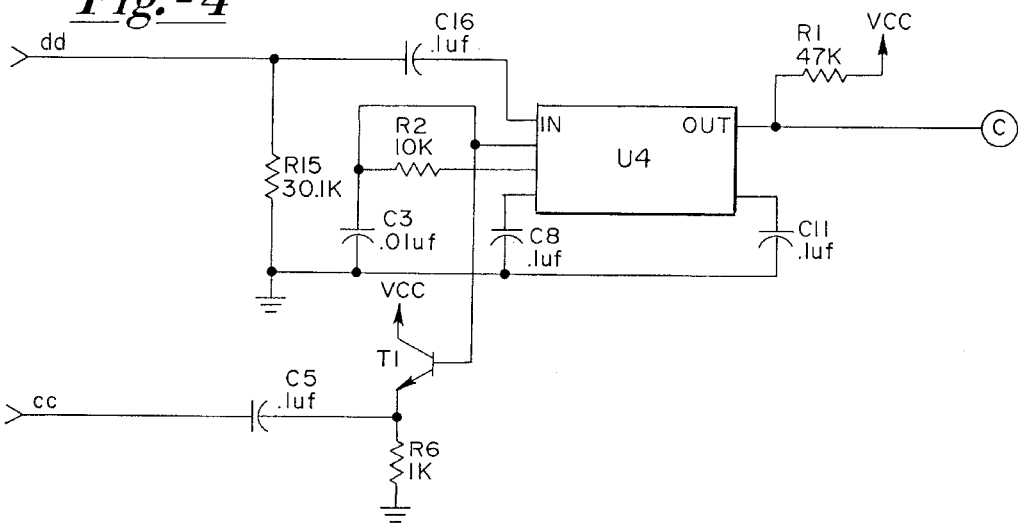
FIG. 4 shows a detailed schematic of the internal signal generator and phase locked loop circuits of the present invention.

As seen by referring to FIG. 4, signal generating and detecting circuit 12 includes resistors R2 and R15 as well as capacitors C3, C16, and C8. Capacitor C16 is electrically connected to line dd and to an input of a phase locked loop detector chip U4. Phase locked loop chip U4 includes a line C connected to micro processor 14 which output is also connected to a resistor RI which in turn is connected to a power supply VCC. Circuit 12 also includes a transistor T1, resistor R6 and capacitor C5, connected to line J7. It will be understood by those of skill that components C3, R2 and U4 combine to generate an analog signal unique to control 10. This signal is internally connected to one-half of detector circuit U4 and also buffered through transistor T1, which is connected to valve lever arm 44 along line cc. The buffered circuit component C5 and R6 provide AC-coupling and biasing to transistor T1. The nozzle input signal from rivet 52 is provided along line dd to filter components C16 and R15 before being applied to phase locked detector circuit U4. Capacitors C8 and C11 select internal phase locked loop filtering characteristics of circuit U4 to filter out low line frequencies and optimize the detect sensitivity of U4. The U4 output signal is terminated directly into microprocessor 14 along line C and includes a pull-up resistor R1.

Figure 5:
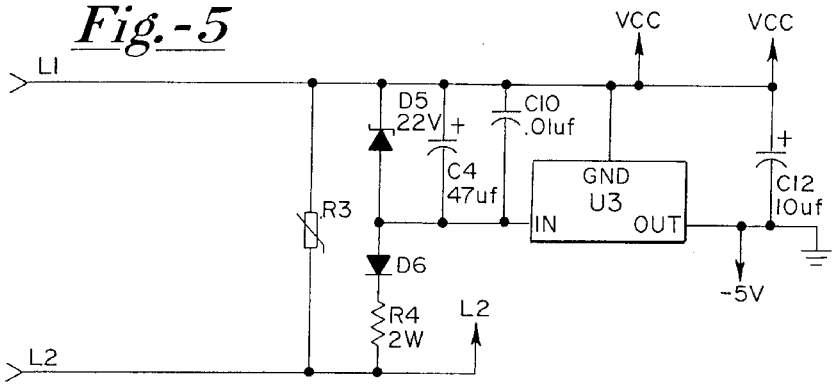
FIG. 5 shows a schematic diagram of the power supply circuit of the present invention.

As seen in FIG. 5, 24V AC current is provided along lines L1 and L2 to power supply circuit 16, and specifically to an input protection circuit consisting of a metal oxide varistor R3, diodes D5 and D6, capacitors C4 and C10 and resistor R4. A negative voltage regulator U3 provides for converting the 24V AC current to a −5V DC current at its output. Power supply 16 is a standard linear voltage regulator type designed to operate over a wide input voltage range, and can be understood by those of skill to provide a low voltage power supply and an input AC voltage level monitoring. Components C4 and D6 provide half wave rectification and filtering of the input AC power before it is applied to the negative 5 volt regulator U3. Components D5 and R4 are used to limit the input voltage applied to U3 under high input voltage conditions. As the line voltage increases, zener diode D5 begins to conduct additional current through R4, thereby increasing the voltage drop across resistor R4 and lowering the voltage applied to U3. Electrical noise transients are attenuated by component C10 and R3. R3 is a metal oxide varister that begins to shunt current as higher than expected input line voltages are applied. Capacitor C3 will filter out any high frequency noise that may reach the input to regulator U3. Capacitor C 12 is an output filter for the regulated low voltage.

Figure 6:
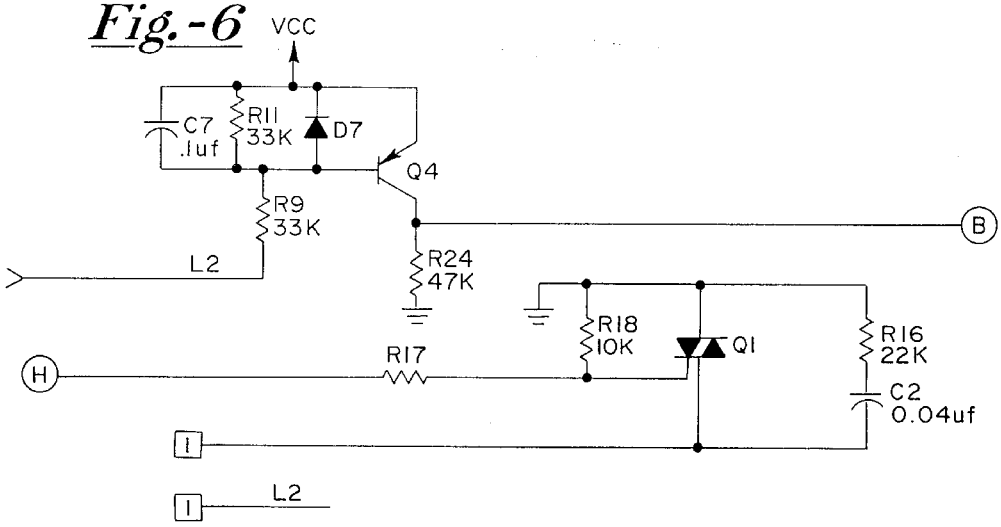
FIG. 6 shows a schematic diagram of the solenoid driver circuit.

As seen by referring to FIG. 6, it will be understood by those of skill that circuit 20 consists of two separate circuits, namely a zero cross detecting circuit and a triac driving circuit. The triac driver circuit consists of triac Q1, triac biasing resistors R17 and R18, and transient suppression components C2 and R16. The output of that drive circuit is provided along line B to microprocessor 14 where triac Q1 provides for switching of solenoid 36. Snubbing protection of triac Q1 is provided by resistor R16 and capacitor C2. The zero cross detector circuit includes capacitor C7, resistors R9, R11, R24, diode D7, and transistor Q4, and is used to minimize in-rush current when the triac driver is switched on, and transient voltage spikes when the triac driver is switched off due to the inductive load from solenoid 36. Transistor switch Q4 turns on during positive, and off during negative voltages of each AC cycle of the input power along line L2, thereby allowing microprocessor 14 to monitor the transition or zero cross. Component C7, D7, R9, and R11 provide the switching bias levels, and input filtering and protection to transistor Q4. Resistor R24 terminates the transistor output signal to switch between ground and VCC.

Figure 7:
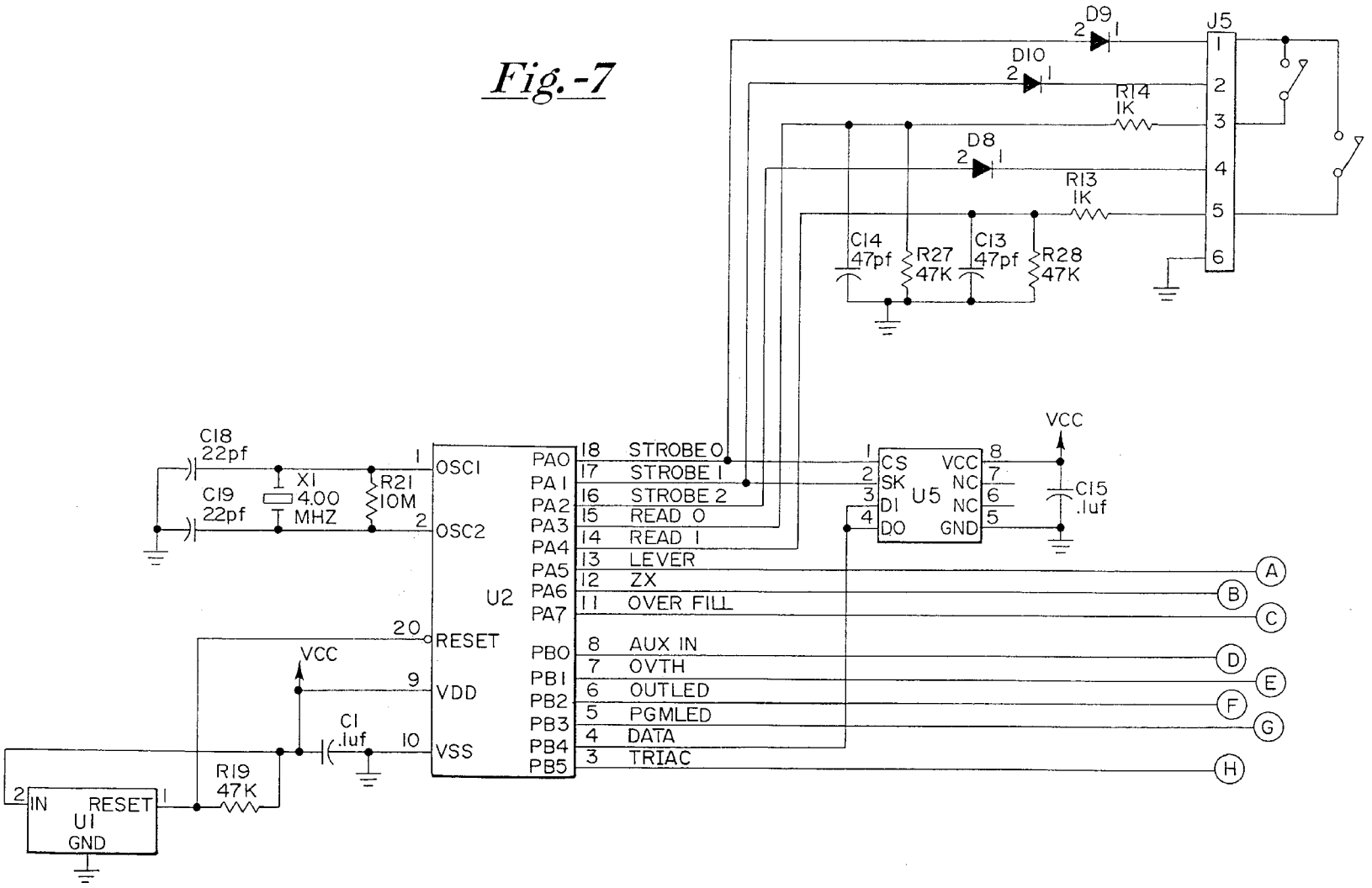
FIG. 7 shows a schematic of the micro-processor and the connections thereto.

As seen in FIG. 7, components C18, C19, R21, and ceramic resonator X1 provide a temperature and voltage stable system clock oscillator to microprocessor 14. Power supervisory circuit U1 monitors the regulated logic power supply and will automatically generate and hold microprocessor 14 in reset when the power is not within proper operating limits. Non-volatile random access memory U5 is provided to allow the software to store both production level information and field program drink parameters that will not be lost when module power is turned off.

Switches 50*a* and 50*b* provide user interface to several features provided by the control software. The present embodiment uses a matrix configuration that the microprocessor continuously scans at periodic intervals under software control. A matrix configuration minimizes the number of corrections needed for large numbers of switches. The matrix configuration was used to maintain compatibility of the microprocessor circuit with other devices not pertaining to the invention herein. The diodes D8–D10 and resistors R3–14, R27–28, and C13–14 are known to those schooled in the art to provide the electrical connections that allow the microprocessor to selectively scan the input switch matrix and determine when a discrete switch has been pressed. The microprocessor software then takes the action defined in its program for that switch closure.

The ground symbol connection is connected to a static shield (not shown) manufactured into the switch panel. It provides a path for any electrical energy transferred by the user to the control by means of an electrostatic discharge (ESD) to the circuit common. This will minimize the operational disruptions common to units that do not provide for static discharge.

Figure 8:
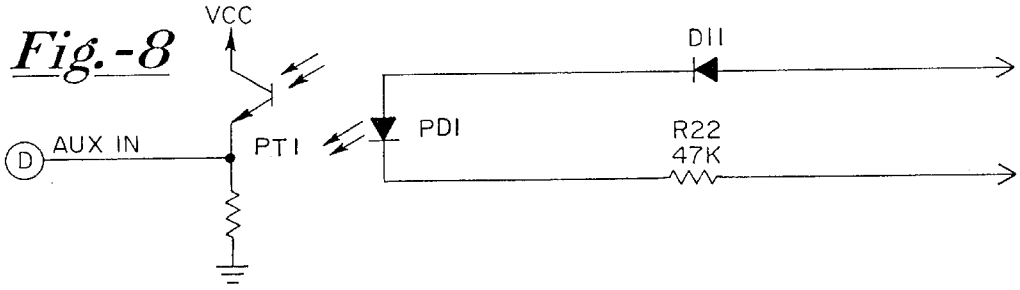
FIG. 8 shows a schematic diagram of an input circuit.

As seen in FIG. 8, circuit 18 includes a protection diode D1 and a current limiting resistor R22 along lines ee and ff respectively. A photo diode PD1 is connected to lines ee and ff, and along with photo transistor PT1, provides for an optical coupling there between. Transistor PT1 is connected to microprocessor 14 along line D. Circuit 18 provides an inhibit signal to microprocessor 14 along line D when a command voltage is present as input along lines ee and ff. This command voltage signal input is optically isolated from the input to microprocessor 14 via photo diode PD1 and photo transistor PT1. This auxiliary input signal is allowed to be either an AC or DC signal between approximately 8.0 and 30.0 volts. Components D11 and R22 provide half wave rectification of any AC voltage and limit current to the LED portion of PD1. Resistor R26 terminates the transistor PT1 to allow the signal to switch between ground and VCC.

Figure 9:
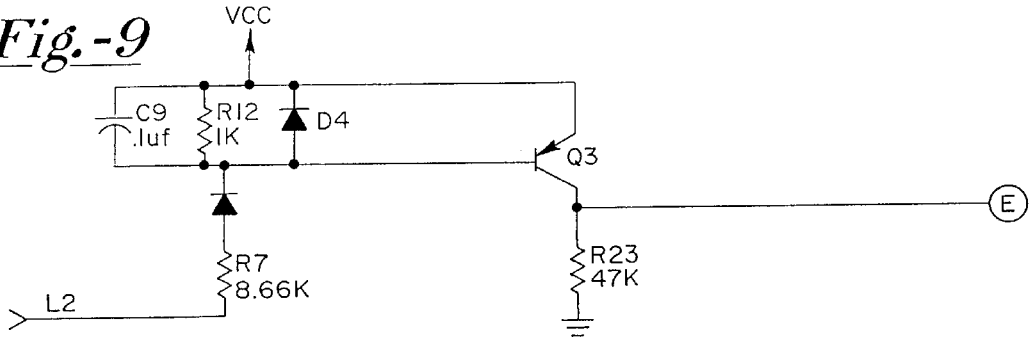
FIG. 9. shows a schematic diagram of a voltage divider circuit.

As seen in FIG. 9 a voltage divider circuit is shown including capacitor C9, resistors R12 and R7, and diodes D4 and D8. This circuit also includes a transistor Q3 connected to micro-processor 14 along line E. This voltage divider circuit functions to continuously monitor the input line voltage to control 10. If the voltage falls below a pre-set level determined by the voltage divider network of component C9, D2, R7, and R12, transistor switch Q3 indicates that status as an input along line E to microprocessor 14. Diode D4 acts to protect transistor Q3 from transient voltage spikes and resistor R23 terminates transistor Q3 to switch between a ground and VCC.

Figure 10:
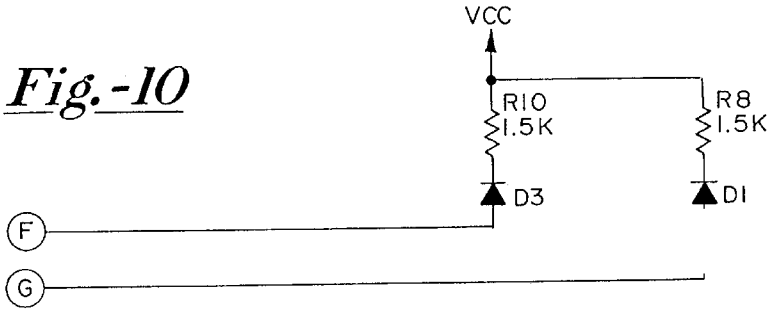
FIG. 10. shows a schematic diagram of a light emitting diode circuit.

As seen in FIG. 10 output F from micro-processor 14 is connected to a light emitting diode 51*a* and the G output thereof is connected to a light emitting diode 51*b*. Resistors R8 and R10 provide current limiting thereto to set the desired light intensity thereof.

Figure 11:
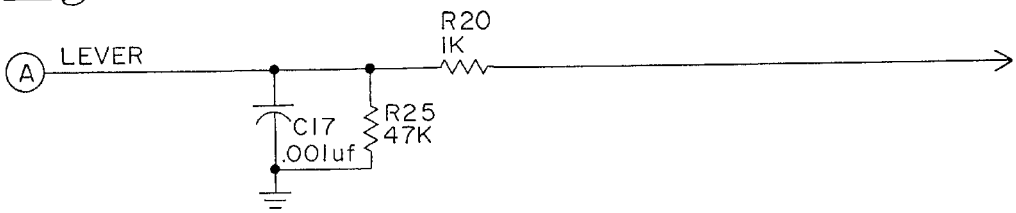
FIG. 11. shows a schematic diagram of a lever input protection circuit.

As seen in FIG. 11 it can be understood that components C17, R20, and R25 protect, filter and terminate respectively the input of lever switch 32 to microprocessor 14 along line A.

Figure 12:
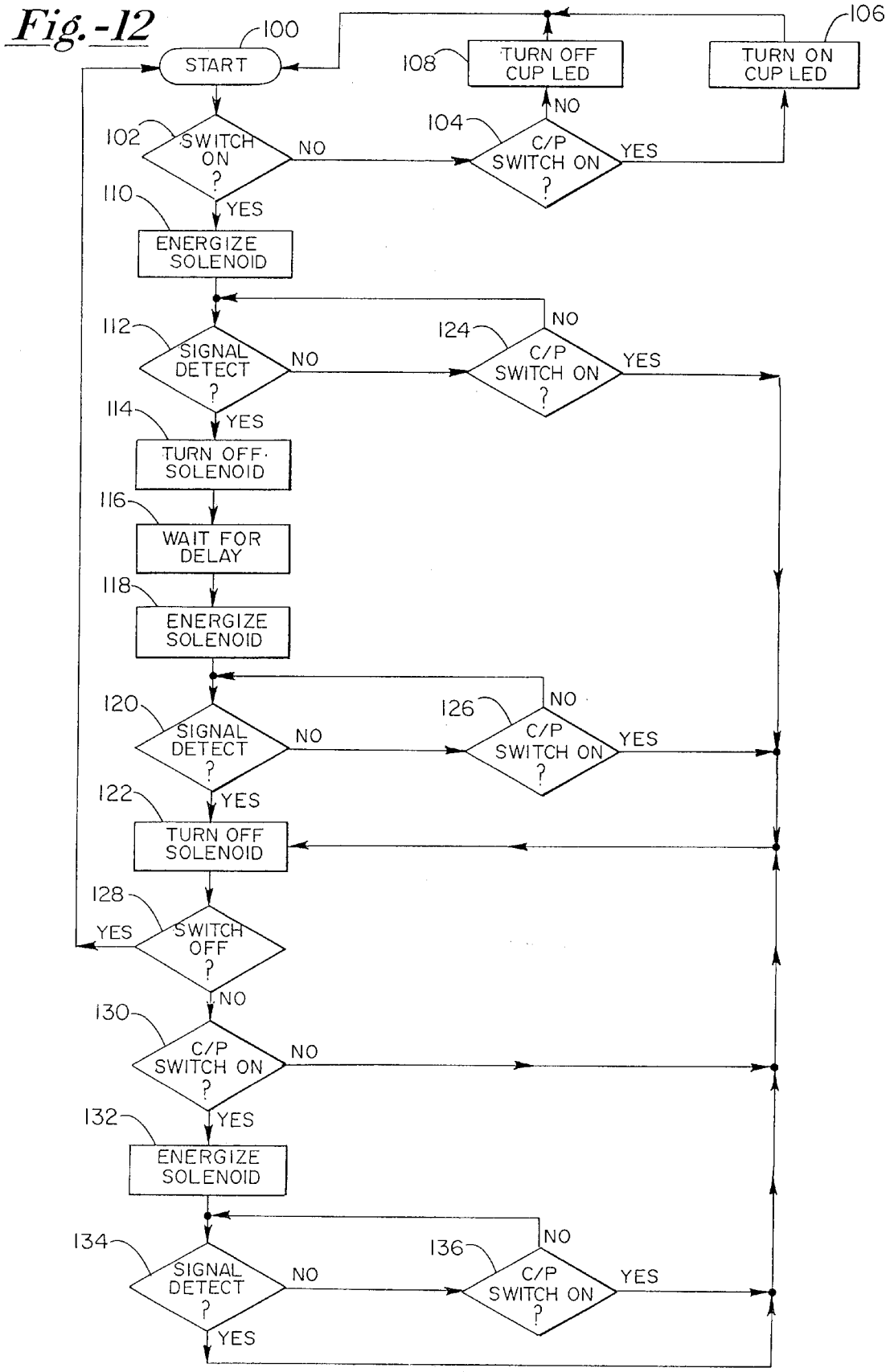
FIG. 12 shows a flow diagram representation of the software control logic of the control of the present invention.

As is understood by those of skill, microprocessor 14 controls the operation of valve 30 with a set of mask-programmed instructions that are internal thereto. The overall operative control of valve 30 by microprocessor 14 with respect to the software programming thereof can be understood by referring to the flow diagram seen in FIG. 12. As seen therein, at start block 100, microprocessor 14 is waiting for a placement of a cup 40 against lever 44 to actuate switch 42. At decision block 102, if the lever is not actuated, and if at block 104 switch 50*a* is on, then at block 106 LED 51*a* is turned on. If, at block 104 switch 50*a* is not on, then at block 108, LED 51*a* is turned off. If however at block 102 actuation of switch 42 is indicated, then at block 110 solenoid 36 is energized and phase locked loop detector U4 and the signal generating circuit of FIG. 4 are operated sending the unique signal to rivet 52. If at block 112 that same signal is seen coming back to phase locked loop detector U4 along lines cc from lever 44, then at block 114, solenoid 36 is turned off. As long as the signal is not detected, solenoid 36 will continue to be energized and the signal sent. At block 116 a delay period is allowed to elapse after which at block 118 solenoid 36 is again energized and a signal sent to rivet 52. If at block 120 that signal is again detected, solenoid 36 is turned off at block 122. It will be appreciated by those of skill that blocks 116 through 122 incorporate a top-off feature. In particular, beverage foam generated during dispensing can flow over rim 40*a* to provide sufficient continuity to stop dispensing. The delay feature allows for settling of any such foam so that upon re-initiating of dispensing, a full measure of beverage can be added to a cup 40. Of course, the top-off feature is not necessary for practicing the invention herein, which invention concerns the generation and recognition of a unique signal for determining shut-off of the valve but is included as an example of a preferred embodiment. Blocks 124 and 126 question whether or not switch 50*a* is on. In both cases, if the switch is on, this indicates a manually activated desire to terminate dispensing, and such termination is affected by turning off solenoid 36 at block 122. If cancel pour switch 50*a* is not activated, then the energizing and signal sending continue until the signal is detected at either block 112 or 120 respectively. At block 128 it is determined whether or not switch 42 has been turned off, i.e., cup 40 has been removed from contact with lever 44. If so, the program is returned to start. If not, and if at block 130 cancel pour switch 50*a* is on, then at block 132 solenoid 36 is energized and the signal sent. If no signal is detected at block 134, such loop continues until the returning signal is detected after which the solenoid is turned off at block 122. At block 136 switch 50*a* is polled, and if on, solenoid 36 is turned off. If not, the loop is allowed to continue. It will be understood by those of skill, that blocks 130 through 136 permit a further number of top-off cycles manually initiated by activating switch 50*a* at block 130. Subsequent activation of switch 50*a* at block 136 serves to stop the dispensing. If at block 126 switch 42 is turned off by movement of lever 44, then the subsequent steps in blocks 130 through 136 are not permitted. It will be understood by those of skill that operation of lever 44 to turn on switch 42 is a condition that is polled by the software continuously. In other words, if at any point during the flow diagram of FIG. 12, for example, cup 40 is removed and lever 44 allowed to swing to its normal position turning off switch 42, dispensing is immediately stopped. Also, the sold out circuitry, as represented by FIG. 8, is also constantly reviewed by the software of the present invention. Thus, if some dispense defeating condition occurs, such as no more syrup, carbonated water or carbon dioxide, dispensing is immediately terminated. Thus, in the case of switch 42 being turned off or a sold out condition arising, dispensing immediately ceases. And in the case of a sold out condition, the re-energizing of solenoid 36 is prohibited until the sold out condition is rectified.

We claim:

1. A control for regulating the dispensing of an electrically conductive liquid from a valve into a substantially non-electrically conductive receptacle wherein the valve has an electrically operable valve actuator for opening the valve for permitting a flow of the liquid therefrom into the receptacle and for closing the valve for stopping the flow of the liquid therefrom into the receptacle, the control comprising:

a first electrically conductive contact for positioning adjacent a top rim of the receptacle, a second electrically conductive contact for positioning in the flow of the liquid as it flows from the valve into the receptacle, a signal generating circuit for generating a unique electrical signal with respect to the frequency and phase thereof and connected to the second contact for delivering the unique signal thereto, a signal detecting circuit connected to the first electrically conductive contact for comparing any electrical signal received by the first electrically conductive contact with the unique signal so that if the received signal is the same as the unique signal with respect to frequency and phase thereof a valve close signal is generated for operating the valve actuator to stop the flow of liquid from the valve.

2. The control as defined in claim 1, and further including a top-off circuit whereby after a first valve close signal results in stopping of the flow of the liquid a delay period is timed after the expiration of which the valve actuating means is again operated to open the valve for permitting a further flow of the liquid into the receptacle until a second subsequent valve close signal occurs.

3. The control as defined in claim 1, and further including a manually operable switch for operating the valve actuator to open the valve to initiate a flow of the liquid into the receptacle as the result of manual operation thereof.

4. The control as defined in claim 1 and the signal generating and signal detecting circuits including a phase locked loop chip.

5. A control for regulating the dispensing of an electrically conductive liquid from a valve into a substantially non-electrically conductive receptacle wherein the valve has an electrically operable valve actuator for opening the valve for permitting a flow of the liquid therefrom into the receptacle and for closing the valve for stopping the flow of the liquid therefrom into the receptacle, the control comprising:

a first electrically conductive contact for positioning adjacent a top rim of the receptacle, a second electrically conductive contact for positioning in the flow of the liquid as it flows from the valve into the receptacle, a signal generating circuit for generating a unique electrical signal with respect to the frequency and phase thereof and connected to the first electrically conductive contact for delivering the unique signal thereto, a signal detecting circuit connected to the second electrically conductive contact and to the signal generating circuit for comparing any electrical signal conducted through the electrically conductive liquid between the first and second contacts with the unique signal so that if the received signal is the same as the unique signal with respect to frequency and phase thereof a valve close signal is generated for operating the valve actuator to stop the flow of liquid from the valve.

6. The control as defined in claim 5, whereby after a first valve close signal results in stopping of the flow of the liquid a delay period is timed after which the valve actuating means is again operated to open the valve for permitting a further flow of the liquid into the receptacle until a second subsequent valve close signal occurs.

7. The control as defined in claim 5 and the signal generating and signal detecting circuits including a phase locked loop chip.

8. The control as defined in claim 5, and further including a manually operable switch for operating the valve actuator to open the valve to initiate a flow of the liquid into the receptacle as the result of manual operation thereof.

9. The control as defined in claim 8, and the manually operable switch operated by a lever arm pivotally depending below the valve and the lever arm comprising the first electrically conductive contact.

10. The control as defined in claim 9, and further including a top-off circuit whereby after a first valve close signal results in stopping of the flow of the liquid a delay period is timed after the expiration of which the valve actuating means is again operated to open the valve for permitting a further flow of the liquid into the receptacle until a second subsequent valve close signal occurs.

11. The control as defined in claim 8, and the manually operable switch operated by a lever arm pivotally depending below the valve and the lever arm comprising the first electrically conductive contact.

12. The control as defined in claim 11, whereby after a first valve close signal results in stopping of the flow of the liquid a delay period is timed after which the valve actuating means is again operated to open the valve for permitting a further flow of the liquid into the receptacle until a second subsequent valve close signal occurs.

13. A beverage dispensing valve for filling a receptacle with beverage and automatically stopping the filling thereof when the receptacle is full, comprising:

a switch for initiating dispensing into the receptacle, the switch operable by movement of the receptacle against a lever arm pivotally suspended from the valve and depending there below, the lever arm being electrically conductive, a control, the control having a signal contact in fluid electrical conductivity contact with the beverage before it flows therefrom into the receptacle, and the control providing for generating a unique electrical signal with respect to the frequency and phase thereof so that the unique signal is provided to the beverage through the signal contact, and the control providing for comparing the unique signal with any signal received by the lever arm for shutting off the valve when the received signal is determined to be the same as the generated signal.

14. The control as defined in claim 13, whereby after a first valve close signal results in stopping of the flow of the beverage, a delay period is timed after which the valve actuating means is again operated to open the valve for permitting a further flow of the beverage into the receptacle until a second subsequent valve close signal occurs.

15. The control as defined in claim 13 and the signal generating and signal detecting circuits including a phase locked loop chip.

16. A beverage dispensing valve for filling a receptacle with beverage and automatically stopping the filling thereof when the receptacle is full, comprising:

a switch for initiating dispensing into the receptacle, the switch operable by movement of the receptacle against a lever arm pivotally suspended from the valve and depending there below, the lever arm being electrically conductive, a control, the control having a signal contact in fluid electrical conductivity contact with the beverage before it flows therefrom into the receptacle, and the control providing for generating a unique electrical signal with respect to the frequency and phase thereof so that the unique signal is provided to the lever arm, and the control providing for comparing the unique signal with any signal received by the signal contact for shutting off the valve when the received signal is determined to be the same as the generated signal.

17. The control as defined in claim 16, whereby after a first valve close signal results in stopping of the flow of the beverage, a delay period is timed after which the valve actuating means is again operated to open the valve for permitting a further flow of the beverage into the receptacle until a second subsequent valve close signal occurs.

18. The control as defined in claim 16 and the signal generating and signal detecting circuits including a phase locked loop chip.

* * * * *